United States Patent [19]

Hirano et al.

[11] Patent Number: 4,459,826

[45] Date of Patent: Jul. 17, 1984

[54] REFRIGERATOR

[75] Inventors: Yoshimi Hirano; Takashi Shigeta, both of Osaka, Japan

[73] Assignee: Tokyo Shibaura Denki Kabushiki Kaisha, Kawasaki, Japan

[21] Appl. No.: 336,406

[22] Filed: Dec. 31, 1981

[30] Foreign Application Priority Data

Jan. 19, 1981 [JP] Japan ..... 56-5927

[51] Int. Cl.[3] ..... F25D 11/00

[52] U.S. Cl. ..... 62/430; 62/276; 62/426

[58] Field of Search ..... 62/430, 439, 276, 426, 62/438; 126/400

[56] References Cited

U.S. PATENT DOCUMENTS 3,848,429 11/1974 Franklin, Jr. ..... 62/430

FOREIGN PATENT DOCUMENTS 45-27703 10/1970 Japan ..... 62/276

*Primary Examiner*—Albert J. Makay
*Assistant Examiner*—Henry Bennett
*Attorney, Agent, or Firm*—Cushman, Darby and Cushman

[57] ABSTRACT

A refrigerator has a first cooling device i.e. a direct cooling evaporator and a second cooling device i.e. an indirect cooling device to cool a circulating air in a refrigerator box, in which a cold storage member is attached to the direct cooling evaporator whereby when the indirect cooling evaporator is heated for defrosting, the temperature rise of the direct cooling evaporator due to a refrigerant gas flowed from the indirect cooling evaporator back into the direct cooling evaporator is prevented.

3 Claims, 12 Drawing Figures

FIG. 10
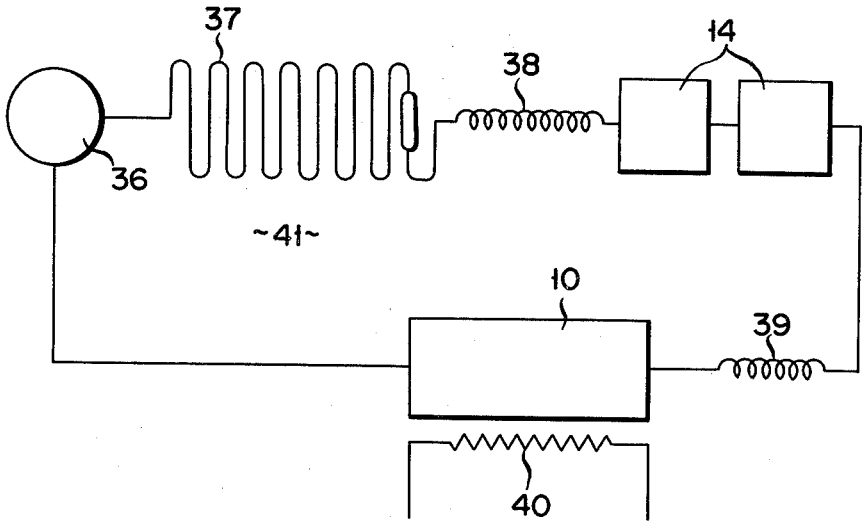
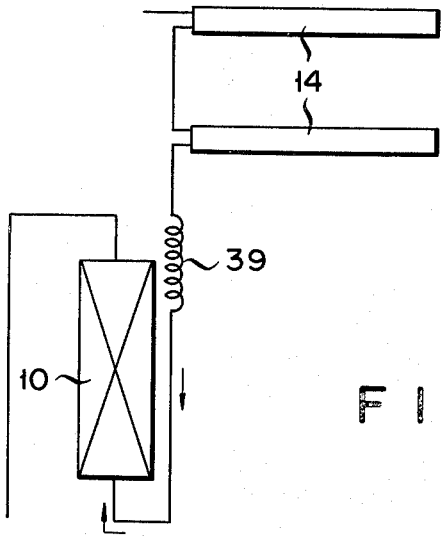
FIG. 11

REFRIGERATOR

BACKGROUND OF THE INVENTION

This invention relates to a refrigerator equipped with a direct cooling evaporator and indirect cooling evaporator.

A refrigerator of this type equipped with an indirect cooling evaporator is known as a fan cooling type refrigerator in which air in the refrigerator box including a refrigerating chamber and a freezing chamber, which is circulated by a fan is cooled by the evaporator to cause storage food to be cooled. This type of the refrigerator has an advantage of producing no deposited frost on the wall of the freezing chamber and a disadvantage of requiring a longer time of making ice or freezing the food. A refrigerator has recently been developed in which in addition to the indirect cooling evaporator a direct cooling evaporator is disposed in that freezing chamber portion facing a fan blow outlet for cooling air and the ice-making and the freezing are made for a brief period of time with an ice tray or a freezing food arranged on, or in contact with, the direct cooling evaporator.

In this case, the freezing cycle is such that part of a refrigerant entering into the direct cooling evaporator from a condenser through a capillary tube is evaporated there and the remaining refrigerant is sent through the next capillary tube into the indirect cooling evaporator where it is all evaporated, permitting a return of it to a compressor. A temperature during the cooling operation of the indirect cooling evaporator is set lower than the temperature of the direct cooling evaporator and deposited frost is produced only on the indirect cooling evaporator. Since the evaporator only is heated by providing a defrost heater etc., it is possible to prevent a temperature rise of the direct cooling evaporator and thus the ice tray and frozen food arranged on, or in contact with, the evaporator.

It has, however, been found that, since during the defrosting operation the compressor is usually stopped and thus the refrigerant circulation is stopped, part of the refrigerant gas in the indirect cooling evaporator which is raised in its temperature is flowed back into the preceding stage direct cooling evaporator through the capillary tube or heat conduction etc. through the tube wall is also involved, causing the direct cooling evaporator and thus ice cubes in the ice tray and frozen food to rise in their temperature and causing them to be melted or thawed with the resultant deterioration.

SUMMARY OF THE INVENTION

It is accordingly the object of this invention to provide a refrigerator which can suppress a temperature rise in a direct cooling evaporator when the defrosting of an indirect cooling evaporator is effected and can prevent a bad effect, such as melting or deteriorating thawing, on ice cubes in an ice tray and frozen food.

According to this invention there is provided a refrigerator comprising a refrigerator box partitioned into a freeizing chamber, refrigerating chamber and cooling chamber communicating with these chambers; a first cooling device disposed within the freezing chamber; a fan device disposed in the cooling chamber to permit circulation of air in the freezing and refrigerating chambers i.e. air in the refrigerator box; a second cooling device provided in the cooling chamber for cooling the circulating air, communicating with the first cooling device and set such that a temperature during the cooling operation is lower than that of the first cooling device; a heating means for defrosting which is provided on the second cooling device only; and a cold storage means provided on the first cooling device.

BRIEF DESCRIPTION OF THE DRAWINGS

FIG. 10 is a diagrammatic view showing a freezing cycle;

FIG. 11 is an explanatory view showing a connection between the indirect cooling evaporator and the direct cooling evaporator in the freezing cycle.

DETAILED DESCRIPTION OF THE PREFERRED EMBODIMENTS

This invention will now be explained below by referring to the accompanying drawings.

Figure 1:
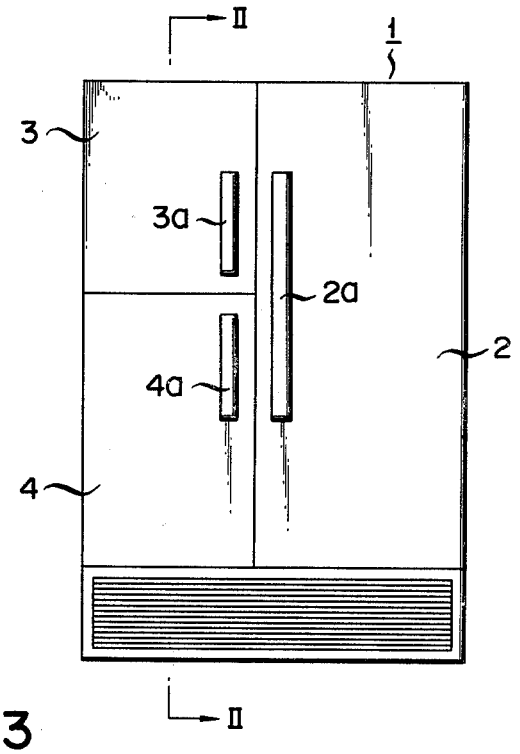
FIG. 1 is a front view showing an outer appearance of a refrigerator according to one embodiment of this invention.
Figure 3:
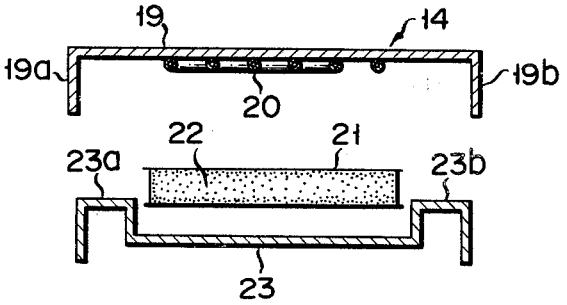
FIG. 3 is a front view showing a pre-assembled direct cooling evaporator and cold storage member.
Figure 4:
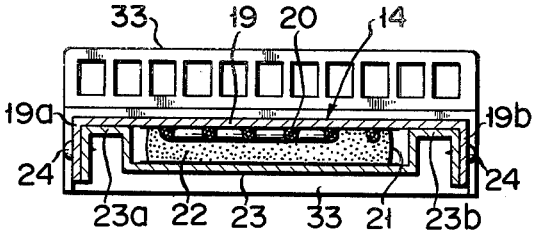
FIG. 4 is a front view showing the evaporator and cold storage member after they are assembled.
Figure 2:
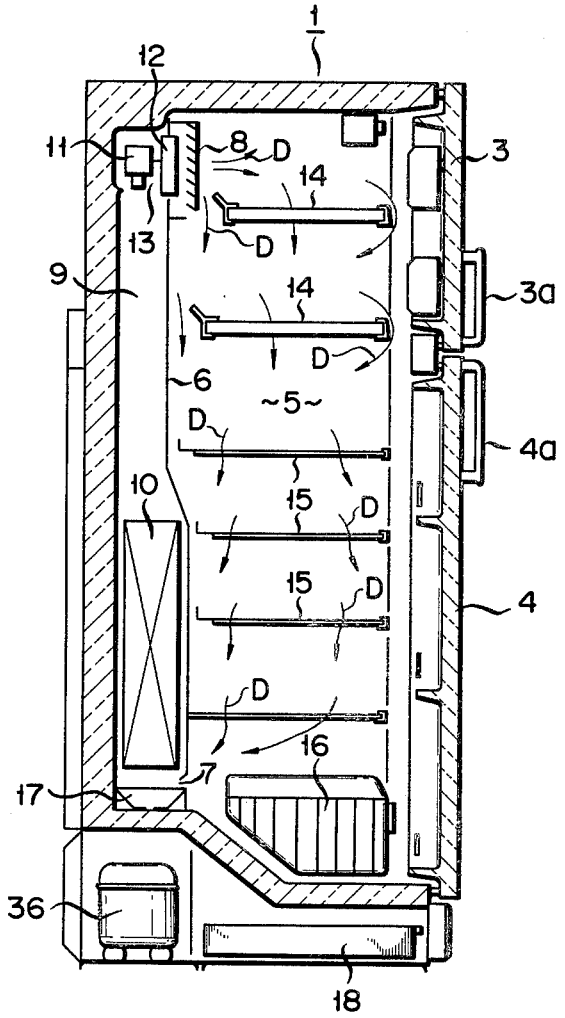
FIG. 2 is a side view in longitudinal cross-section, as taken along line II—II in FIG. 1.
Figure 5:
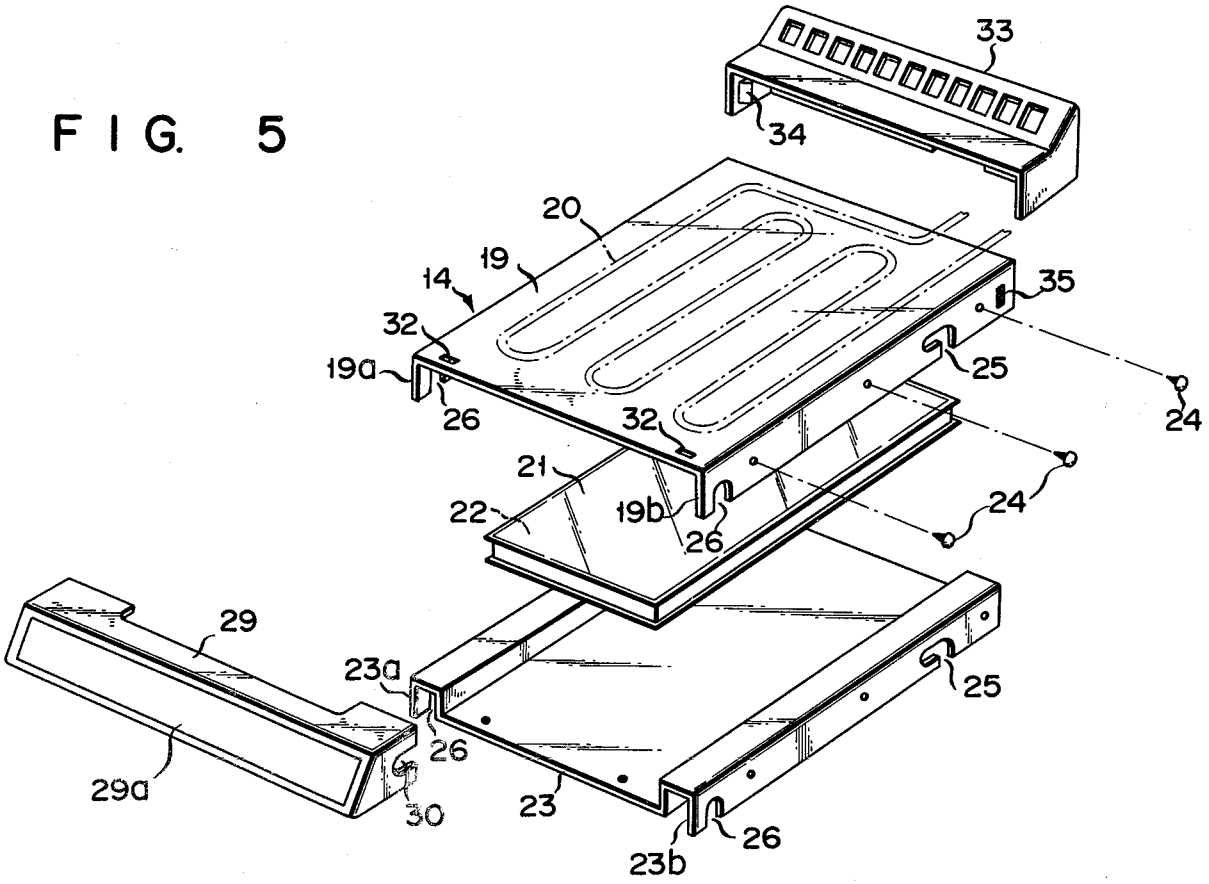
FIG. 5 is a perspective view showing the direct cooling evaporator and cold storage member of FIG. 3 before they are assembled.
Figure 6:
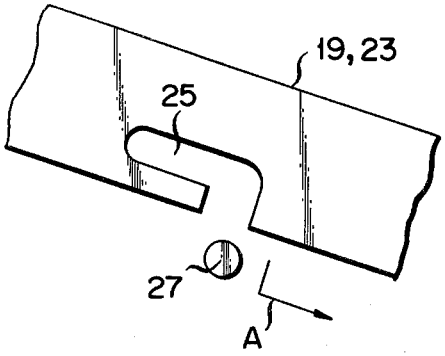
FIGS. 6 and 7 are explanatory views showing a mounting means for a cooling chamber of a direct cooling evaporator.
Figure 7:
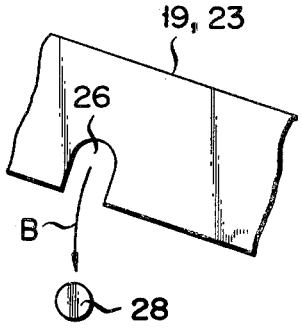
Figure 8:
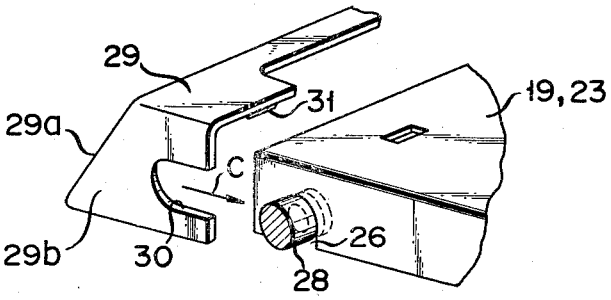
FIG. 8 is a partial, enlarged, perspective view showing a hooking means of the direct cooling evaporator after mounting is made as shown in FIG. 7.
Figure 9:
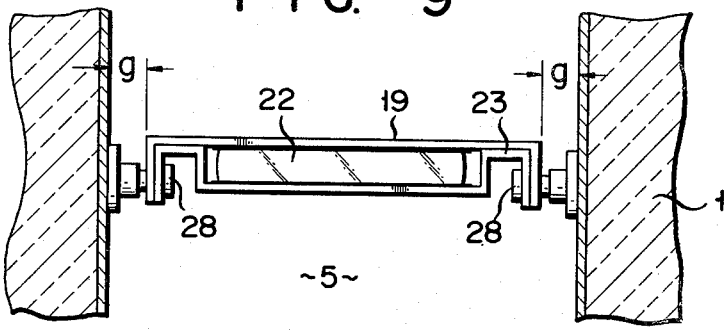
FIG. 9 is a front view showing the state of mounting relative to the freezing chamber of the direct cooling evaporator.

In FIG. 1, reference numeral 1 shows a refrigerator box partitioned into a freezing chamber and refrigerating chamber; 2, a door for the refrigerating chamber which has a grip 2*a;* 3, an upper door for the freezing chamber which has a grip 3*a;* and 4, a lower door for the freezing chamber which has a grip 4*a*. In FIG. 2, reference numeral 5 shows the freezing chamber in the box which confronts both the doors 3, 4 for the freezing chamber. A partition wall 6 is disposed at the rear side of the freezing chamber with a predetermined spacing kept relative to the wall surface of the freezing chamber. A cooling chamber 9 is provided with an air inlet 7 at the lower side and an air outlet 8 at the upper side thereof and communicates with a duct section. A second cooling device i.e. an indirect cooling evaporator 10 is located at the lower portion of the cooling chamber 9. A fan device 13 which forces the cooled air circulation in the refrigrator box is located at the upper section of the cooling chamber 9 and comprises a motor 11 and blade 12. Reference numeral 14 shows a first cooling device i.e. a direct cooling evaporator disposed in upper and lower stages at that upper area of the freezing chamber 5 which confronts the air outlet 8 and upper door 3. Reference numeral 15 shows a plurality of shelves disposed in the middle area of the freezing chamber 5; 16, an article receptacle; 17, a dew tray disposed below the indirect cooling evaporator 10; 18, an evaporating tray disposed outside the refrigerator box and communicating with the dew tray 17 through a communicating means, not shown; and 36, a compressor located in a machine chamber which is positioned outside the refrigerator box 1 such that it is located at the lower side of the box. As shown in FIG. 3 the direct cooling evaporator is formed by causing an evaporator, i.e. a refrigerant path 20, comprised of a metal tube such as an aluminium tube to be meanderingly arranged on the lower surface of a metal plate downturned at their side edges 19*a*, 19*b*, for example, a heat transfer plate 19 made of aluminium. To the lower side of the resultant structure is attached a cold storage member 22 which is obtained by sealing a cold storage agent 22' (for example, an agent containing as a main constituent element an electrolytic solution such as KCl to which a gelling agent is added and having a temperature of −11° to −12°, a melting latent freezing heat of 70 Kcal/kg.deg. and a coefficient of expansion of about 7 to 8%) into a non-rigid vinyl chloride flat bag 21 which is incorporated with nylon fibers. The resultant structure is covered by a cover 23 from below to permit the member 22 to be intimately contacted with the lower surface of the heat transfer plate 19 and the lower surface of the tube 20 on the lower surface of the plate 19, as shown in FIG. 4. The cover 23 is fixed by rivets to the heat transfer plate 19 by downturning the side edge portions into substantially U-shaped configurations with the top surface and outer side wall surfaces of the substantially inverted U-shaped sections abutted against the lower surface and lower side surfaces of the heat transfer plate 19. The direct cooling evaporator 14 is mounted by below-mentioned fitting means on the freezing chamber 5 with the cold storage member 22 sandwiched between the heat transfer plate 19 and the cover 23. As shown in FIG. 5, inverted L-shaped cutout mounting portions 25 are provided at the rear portions of the side surfaces 19*a*, 19*b* of the heat transfer plate 19 and side surfaces 23*a*, 23*b* of the cover 23, and inverted U-shaped cutout mounting portions 26 are provided at the front portions of the side surfaces 19*a*, 19*b* of the heat transfer plate 19 and side surfaces 23*a*, 23*b* of the cover 23. First, the openings of the mounting portions 25 are aligned with supporting pins 27 projected from the side wall surfaces of the upper portion of the freezing chamber 5 with the evaporator inclined from the front side toward the rear side. Then, the evaporator is moved relative to the pins so as to describe an L-shaped configuration in a direction indicated by an arrow A in FIG. 6 to permit the pins to be fitted into the openings of the mounting portions 25. After the evaporator is brought back to the horizontal state, the mounting portions 26 are caused to confront the support pins 28 projected from the side surfaces of the upper portion of the freezing chamber 5 and then the evaporator is lowered in a direction as indicated by B in FIG. 7 to permit the supporting pins 28 to be fitted in the openings of the mounting portions 26. In this way, the evaporator 14 is mounted on the upper portion of the freezing chamber 5. In FIG. 8, reference numeral 29 shows a front frame with the front surface 29*a* inclined toward the front side. U-shaped cutout mounting portions 30 provided in the inner end portions of the side surfaces 29*b* of the front frame 29 are made to confront the supporting pins 28 and then the front frame 29 is moved in a direction as indicated by an arrow C in FIG. 8 to permit the supporting pins 28 to be fitted in the mounting portions 30. At this time, a hook 31 provided on the rear edge of the upper surface of the front frame is engaged with a hook hole 32 provided in the front edge portion of the upper surface of the heat transfer plate 19. By so doing, the front frame 29 is mounted on the heat transfer plate and at the same time the direct cooling evaporator 14 is prevented from being detached from the chamber wall. The supporting pins 27, 28 have stepped portions as shown in FIG. 9 whereby a clearance g of, for example, about 15 mm for passage of the cooling air is defined between each end of the direct cooling evaporator 14 and the wall surface of the freezing chamber 5. Likewise, a clearance is defined between the front frame 29 and the inner surface of the upper door 3 and between the rear frame 33 in FIG. 5 and the front wall of the partition plate 6. The rear frame 33 is mounted by causing a hook 34 provided on each inner side surface of the rear frame 33 to be engaged with a hook hole 35 provided on the rear portion of each side surface (19*a*, 19*b*) of the heat transfer plate 19.

FIG. 10 shows a freezing cycle. In FIG. 10, reference numeral 36 shows a compressor whose outlet is connected to a condenser 37. The condenser 37 is connected to a first capillary tube 38 which in turn is connected to the direct cooling evaporator 14. The evaporator 14 is connected through a second capillary tube 39 to the in direct cooling evaporator 10. The evaporator 10 is connected to the suction inlet of the compressor 36. In this way, the freezing cycle 41 is completed. A defrosting device 40 is attached to the indirect cooling evaporator 10 only. In the freezing cycle 41, the second capillary tube 39 connected to the direct cooling evaporator 14 is connected to the intake port of the indirect cooling evaporator 10, the intake port being located at the bottom of the evaporator 10, as shown in FIG. 11.

The operation of the refrigerator will now be explained below.

During the cooling operation, a refrigerant supplied under pressure from the compressor 36 is supplied through the condenser 37 and the first capillary tube 38 to the direct cooling evaporator 14 where part of it is evaporated, and the remaining part of the refrigerant is supplied through the second capillary tube 39 to the indirect cooling evaporator 10 where it is all evaporated and returned to the compressor 36, repeating this operation. By this cooling operation, the indirect cooling evaporator 10 is cooled at a temperature lower than the direct cooling evaporator 14 by preferably more than 5° C. Since during the cooling operation the fan device 13 is driven, air in the freezing chamber 5 is sucked from the air inlet 7 into the cooling chamber 9 and sent out from the air outlet 8 through the duct section into the freezing chamber 5. In this way, a circulating path as indicated by an arrow D in FIG. 2 is followed. Thus, the air is cooled and chilled by the indirect cooling evaporator 10 in the cooling chamber 9, causing the cooling of frozen food on the shelf 15 at the middle portion of the freezing chamber or storage articles in the receptacle at the lower portion of the freezing chamber. Water in the ice tray and the frozen food which are placed on or in contact with the direct cooling evaporator 14 is directly cooled by the evaporator 14 and indirectly cooled, like the other storage food, upon receiving the cooling air which is blown off from the air outlet 8. With the further cooling operation, the cold storage member 22 in contact with the lower surface of the heat transfer plate 19 of the direct cooling evaporator 14 is cooled by the refrigerant path 20 and stores a cooling energy. Frost is deposited on the indirect cooling evaporator 10 lower in temperature than the temperature of the direct cooling evaporator 14. Even if frost should be deposited on the direct cooling evaporator 14, it is transferred to the indirect cooling evaporator 14 by a sublimation phenomenon and air blowing of the fan device 13.

Figure 12:
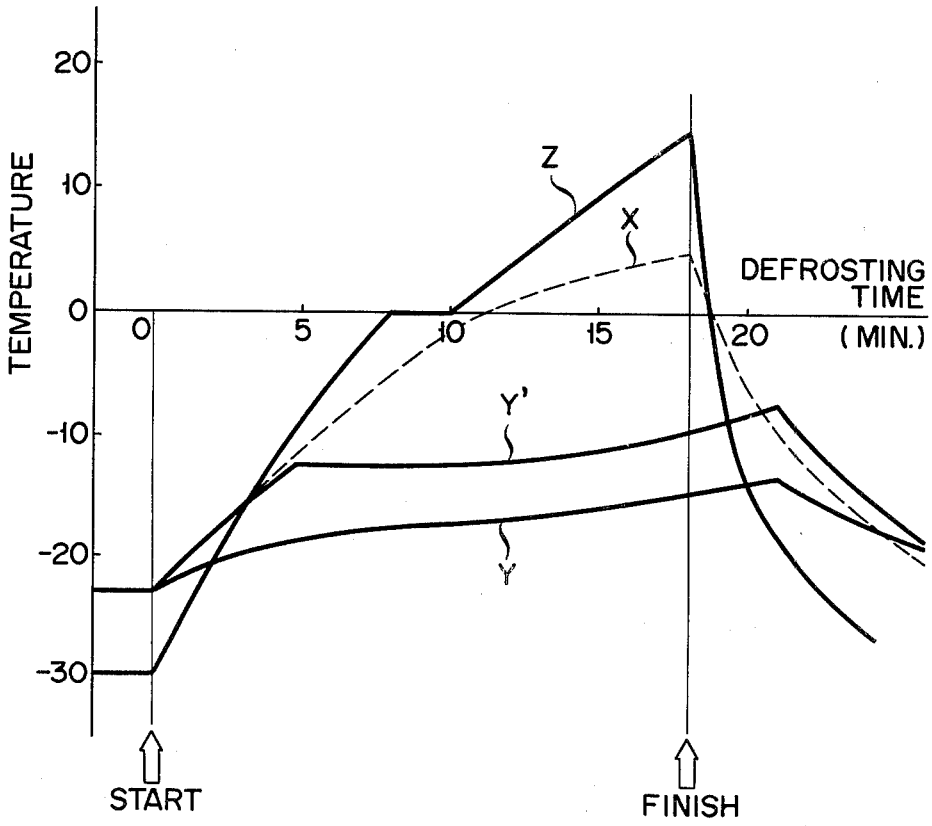
FIG. 12 is a characteristic curve, based on the results of experiments, showing a change in temperature rise of each of the evaporators at the defrosting time.

At the defrosting operation which is effected a predetermined time after a timer (not shown) is set, the compressor 36 is stopped and, instead, the defrosting heater or device 40 is turned ON, heating the indirect cooling evaporator 10 to cause the frost concentratedly deposited on the evaporator 10 to be melted away. The refrigerant gas in the indirect cooling evaporator 10 is raised in its temperature due to the heat generation of the defrosting heater 40 and some of it is flowed back into the direct cooling evaporator 14 through the second capillary tube 39, but it is cooled by the cooling energy stored in the cold storage member 22 which is intimately contacted with the heat transfer plate 19 of the direct cooling evaporator 14 as mentioned above, and suppresses the temperature rise in the direct cooling evaporator 14. Experiments were conducted in connection with a change in the temperature rise of each evaporator during the defrosting operation, under the conditions that under control at no load (100 V 60 Hz) the defrosting cycle occurred once per 12 hours of the compressor operation integrating time and the defrosting time was 15 to 20 minutes (in FIG. 12, the bimetal regaining temperature: 15° C., the defrosting time: 18 minutes) from the starting of the turn-ON of the timer to the regaining of the bimetal. The results of the experiments are as shown in FIG. 12 in which a relation of the temperature of the conventional direct cooling evaporator 14 { as indicated by the broken line (X)} with no cold storage member 22 to the temperature of the direct cooling evaporator 14 {as indicated by solid line (Y)} with a cold storage member 22 (the embodiment of this invention) is shown. As the cold storage member 22 use is made of a flexible container in the form of a package or bag containing 0.7 Kg of a cold storage agent obtained by adding a gelling agent, etc. to a KCl solution as mentioned above. The package is attached to the direct cooling evaporator 14. In FIG. 12, Y' shows the surface temperature of the direct cooling evaporator 14 and Z shows a variation in the temperature of the indirect cooling evaporator 10.

As evident from FIG. 12, with the starting of defrosting of the defrosting heater 40 the temperature X of the direct cooling evaporator with no cold storage member rises from the minus to the plus region (5° C.). On the other hand, the direct cooling evaporator 14 with the cold storage member 22 (this invention) is such that the surface temperature Y' can be controlled to a lower temperature of about −7° C. at the portion of the heat transfer plate 19 in contact with the cooling path 20 and that the temperature Y of the evaporator 14 can be controlled to a lower temperature of about −15° C. at the middle section of the cold storage member 22. Thus, the defrosting of the indirect cooling evaporator 10 can be performed without involving the melting or degenerative thawing of ice cubes in the ice tray or the frozen food.

What we claim is:

1. A refrigerator comprising:

a refrigerator box partitioned into a freezing chamber, refrigerating chamber and cooling chamber communicating with the freezing and refrigerating chambers;

a first cooling device disposed in the freezing chamber a fan device mounted in the cooling chamber to cause air in the freezing and refrigerating chambers to be circulated;

a second cooling device communicating with the first cooling device to permit cooling of the circulating air at arranged so as to operate during a cooling operation at a temperature lower than that of the first cooling device;

heating means, provided on the second cooling device only; and cold storage means provided in proximity to the first cooling device, for minimizing a temperature rise of said first cooling device during a defrosting of said refrigerator that would otherwise occur by convection of heat from outside the refrigerator and a backflow of coolant into said first cooling device, said first cooling device having a heat transfer plate with which an evaporator is meanderingly contacted, and a cover confronting the heat transfer plate on the evaporator side and fitted into the heat transfer plate with said cold storage means held therebetween and wherein said cold storage means has a flexible container and a cold storage agent sealed in the container.

2. A refrigerator according to claim 1, in which said cold storage means has flexible container and a cold storage agent sealed in the container.

3. A refrigerator according to claim 1 in which said first cooling device is detachably mounted on the wall surface of the freezing chamber.

* * * * *